United States Patent [19]

Schreiner

[11] 4,334,715

[45] Jun. 15, 1982

[54] TOTE GUIDE

[75] Inventor: Charles P. Schreiner, Saugatuck, Mich.

[73] Assignee: Westinghouse Electric Corp., Pittsburgh, Pa.

[21] Appl. No.: 212,945

[22] Filed: Dec. 4, 1980

[51] Int. Cl.[3] ..... F16C 29/02

[52] U.S. Cl. ..... 308/3.6; 312/330 R

[58] Field of Search ..... 308/3.6, 3.8, 3 R, 6 R; 312/107, 330 R

[56] References Cited

U.S. PATENT DOCUMENTS

| | | | |
|---|---|---|---|
| 3,664,716 | 5/1972 | Johnson | 308/3.8 |
| 3,752,547 | 8/1973 | Propst et al. | 312/107 |
| 3,826,550 | 7/1974 | Propst et al. | 312/107 |
| 3,929,386 | 12/1975 | Read | 308/3.6 |
| 4,129,347 | 12/1978 | Godtschalck | 312/330 R |
| 4,212,503 | 7/1980 | Litchfield et al. | 308/3.6 |

*Primary Examiner*—Lenard A. Footland

*Attorney, Agent, or Firm*—B. R. Studebaker

[57] ABSTRACT

A tote guide operable in pairs to support a material handling tote beneath a desk, table or the like. Each tote guide includes an elongated tote receiving channel and means to inhibit removal of the tote from the channel without tilting of the tote. The tote guide is adapted to be mounted to the underside of a work surface or to a work surface vertical support.

8 Claims, 8 Drawing Figures

TOTE GUIDE

BACKGROUND OF THE INVENTION

This invention relates to tote guides and more particularly to a tote guide operable in pairs to support material handling totes beneath a desk, table or the like.

In modern manufacturing processes, particularly those employed in the electronics industry, there is a need for a facility to handle large numbers of comparatively small electronic parts such as printed circuit boards and the like. During these manufacturing processes, there is a need to store parts and subassemblies at various stages of that process. For example, the parts and subassemblies need to be stored in large storage areas in large numbers and to have the ability to be moved in large quantities by industrial fork trucks and the like. These parts in smaller numbers also need to be moved from storage areas to work areas by hand carts and the like and be stored at work areas under work surfaces or on vertical wall surfaces for access by manufacturing personnel.

A system has been developed which employs a uniquely designed material material handing tote of the type disclosed in U.S. patent application Ser. No. 212,946, filed the same date, Dec. 4, 1980 as this application for Material Handling Tote by Charles P. Schreiner, et al. The material handling tote may be employed and total material handling system and may be, for example, stored in large numbers on the pallet frame disclosed in U.S. patent application Ser. No. 212,953, filed by Charles P. Schreiner the same date, Dec. 4, 1980, as this application for a Pallet Frame. The tote may also be moved from place to place and stored on a push cart of the type disclosed in copending application Ser. No. 212,954, filed the same date, Dec. 4, 1980, as this application by Charles P. Schreiner for Material Handling Cart. Additionally, the material handling tote may be supported adjacent a work station by either a wall hung support rail of the type disclosed in copending application Ser. No. 212,944, filed by Charles P. Schreiner the same date, Dec. 4, 1980, as this application for a Wall Hung Support Rail or stored beneath a work surface on pairs of tote guides of the type which form the subject matter of this application. Each of the foregoing applications are owned by the same assignee as this application.

SUMMARY OF THE INVENTION

This invention is directed to a tote guide for forming one side of a tote supporting means and is adapted to be employed in pairs for supporting a material handling tote or the like beneath a work surface. The tote guide of this invention includes a top rail, a middle rail, and a bottom rail with a first side member interconnecting the top rail at one side of the middle rail while a second side member interconnects the other side of the middle rail and the bottom rail. Each of the top rail and the first side member include a plurality of mounting apertures therethrough and each of the middle and bottom rails include access apertures therethrough aligned with the mounting apertures in the top rail.

The tote guide is an elongated single piece member with the top rail the first side wall and the middle rail forming a tote receiving channel which is substantially U-shaped in cross section. The middle rail, second side wall and bottom rail also define a second substantially U-shaped channel. The tote guide also includes a front wall which closes off the front end of the second U-shaped channel and a back wall which closes off the ends of each of the U-shaped channels. The top rail and bottom rail are essentially planar and the middle rail includes a depression therein which is aligned with a cam-detent on the underside of the top rail which is arranged to prohibit inadvertent removal of a material handling tote from between the top and middle rails without tilting of the tote support flanges into the depression in the upper surface of the bottom rail.

BRIEF DESCRIPTION OF THE DRAWING

Many of the attended advantages of the present invention will become more readily apparent and better understood as the following detailed description is considered in connection with accompanying drawing in which:

FIG. 8 is an illustration of several tote guides of this invention supporting material handling totes beneath a desk, table or the like.

DESCRIPTION OF THE PREFERRED EMBODIMENT

Figure 1:
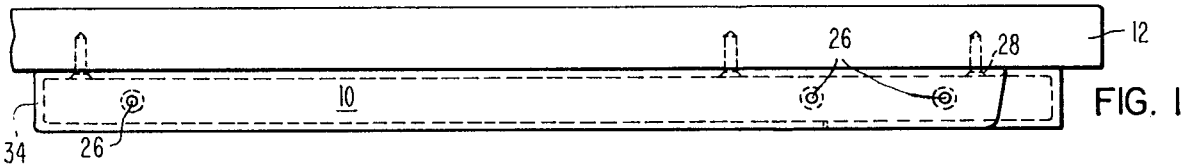
FIG. 1 is a top plan view of a side mounted tote guide.
Figure 2:
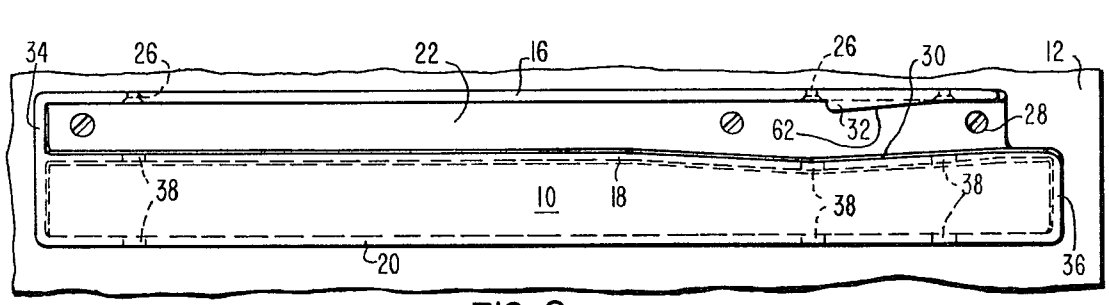
FIG. 2 is a side elevation view thereof.
Figure 3:
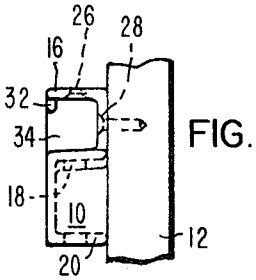
FIG. 3 is an end elevation view thereof.

Referring now in detail to the drawing wherein like reference characters represent like parts throughout the several views, there is illustrated in FIGS. 1–3 the tote guide of this invention, generally designated 10, mounted to a vertical support member 12 which may be a vertical support for a desk, table or the like or alternatively could be one side wall of a cabinet. FIGS. 1–3 illustrate the tote guide of this invention mounted in its side mounting mode whereas FIG. 4 illustrates the tote guide mounted to the underside of the horizontal surface of a desk, table or the like.

The tote guide 10 of this invention includes a top rail 16, a middle rail 18, and a bottom rail 20. The top rail 16 is connected to the middle rail 18 by a side wall or member 22 and the middle rail 18 is connected to the bottom rail 20 by a side member or wall 24. The top rail 16 is provided with a plurality of mounting apertures 26 therethrough while the side wall or member 22 is provided with a plurality of similar mounting apertures 28 therethrough to facilitate mounting the tote guide 10 in its side mounted mode as opposed to the top mounted mode provided by the mounting apertures 26 in the top rail 16.

The top rail 16 and the bottom rail 20 are essentially planar while the middle rail 18 is provided with a depression 30 near the front end thereof. A cam detent 32 is provided on the underside of the top rail 16 and essentially overlies the depression 30 in the middle rail 18 for purposes that will be latter described.

Figure 4:
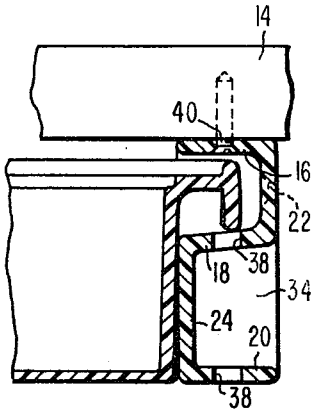
FIG. 4 is a sectional view of a top mounted tote guide illustrating a material handling tote received therein.

As will be best illustrated in FIGS. 3 and 4 the top rail 16 first side wall 22 and middle rail 18 form a first U-shaped channel facing in one direction while the middle rail 18 side wall 24 and bottom rail 20 form a second U-shaped channel facing in the opposite direction. There is also provided on the elongated single piece tote guide a back wall 34 which closes off the ends of both of the U-shaped channels while a front wall 36 closes off only the lower U-shaped channel thus providing an opening in the front end of the upper U-shaped channel for receiving a material handling tote of the type disclosed in the aforementioned copending application Ser. No. 212,946. Each of the middle rail 18 and the bottom rail 20 are provided with access apertures 38 therethrough which are aligned with the mounting apertures 26 in the top rail 16 to permit access to a screw 40 when top mounting of the tote guide is desired as illustrated in FIG. 4. The apertures 38 in the bottom rail 20 also provide for the interconnection of a plurality of tote guides in a vertical orientation. For example, a bolt can be placed through the aperture 26 in the top rail of a next lower tote guide and secured with a nut on the interior of the lower U-shaped channel of the next above tote guide as the bolt extends through the bottom access aperture 38 in the bottom rail 20 of that next above tote guide.

Figure 7:
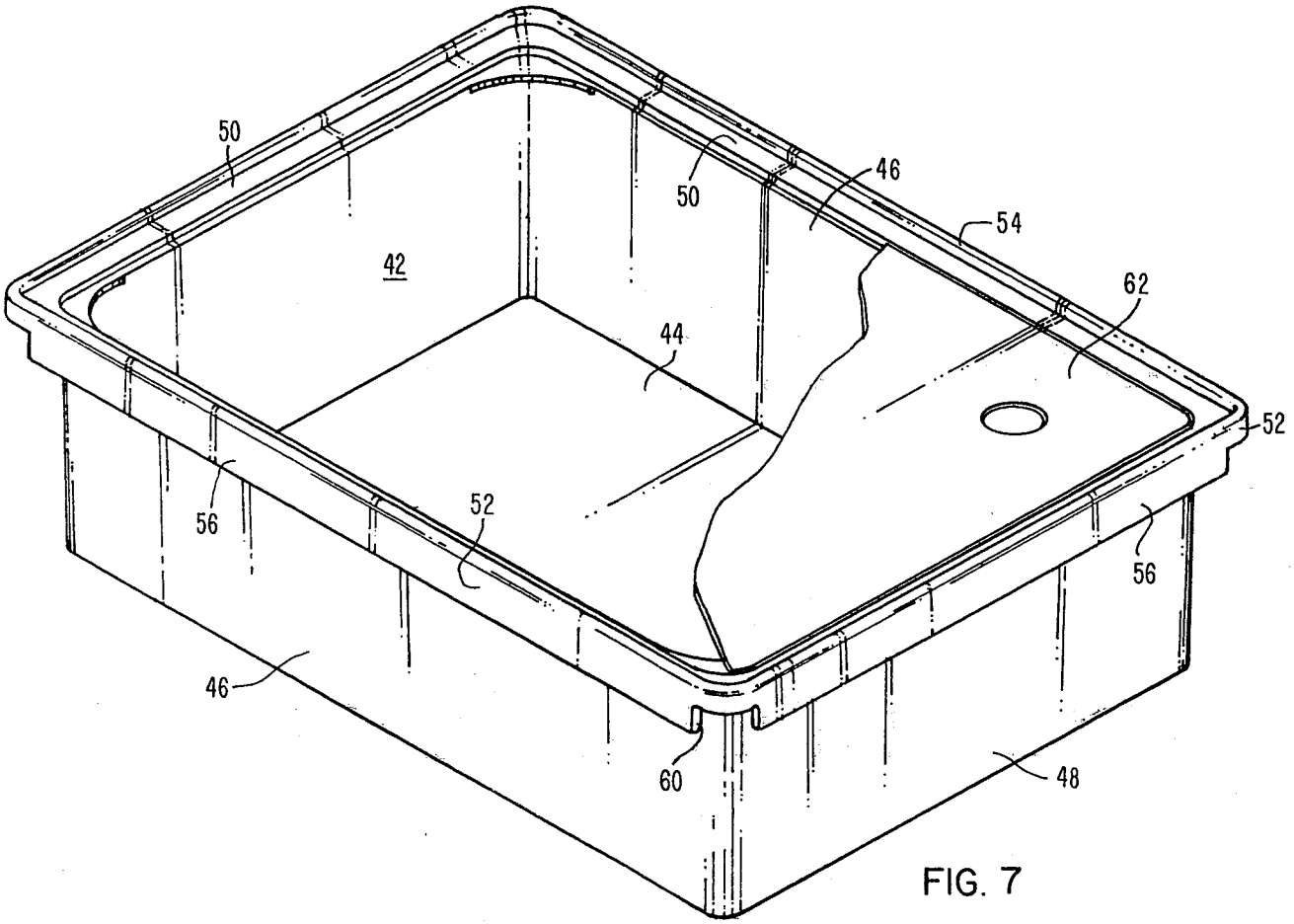
FIG. 7 is a perspective view of a material handling tote of the type which may be accommodated by the tote guide of this invention.

There is illustrated in FIG. 7 a material handling tote of the type disclosed in copending application Ser. No. 212,946 which is a rectangular open topped container having a bottom 44, a pair of side walls 46, and a pair of end walls 48. A continuous outwardly directed horizontal flange 50 extends above and outwardly at the top edge of the side walls and end walls substantially parallel to the bottom of the container and is provided with a vertical flange 52 on its outer periphery which includes an upper portion 54 which extends above the horizontal flange 50 for the entire periphery of the entire horizontal flange and below the horizontal flange for a distance substantially equal to the lengths of the end walls and the side walls of the tote thereby defining openings 60 in the flange 52 at the corners of the container. The container or material handling tote 42 may also be provided with a recessed lid 62.

Figure 8:
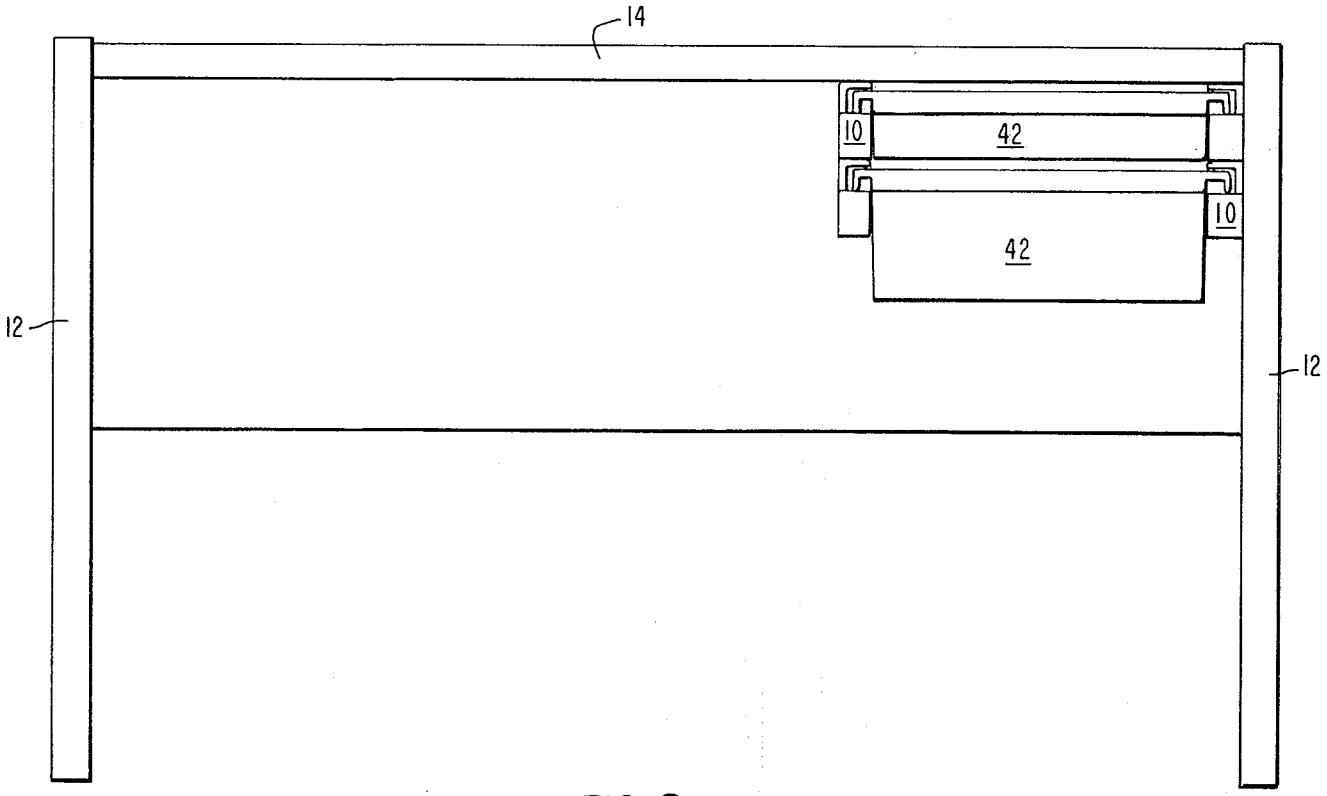

As will be seen from FIG. 8 a plurality of tote guides 10 may be employed together to accommodate a plurality of material handling totes 42. The tote guides 10 may be secured to the under side of a work surface 14 in a vertical array as illustrated on the left hand side of FIG. 8 or side mounted to the vertical support 12 of a desk or table as illustrated on the right hand side of FIG. 8.

Figure 6:
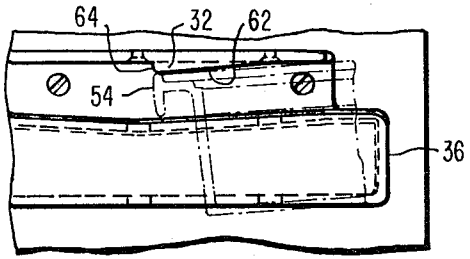
FIG. 6 is a partial side elevation view similar to FIG. 5 illustrating the removal of a material handling tote from the tote guide.
Figure 5:
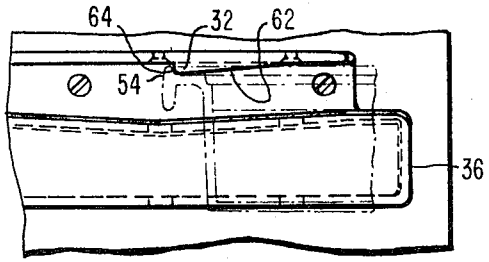
FIG. 5 is a partial side elevation view similar to FIG. 2 illustrating a tote being prohibited from removal from the tote guide.

Referring now to FIGS. 4, 5, and 6 there is illustrated the method by which the tote guides 10 receive a material handing tote 42. The material handling tote 42 rides into the upper U-shaped channel by the bottom edge of the lower flange 56 riding on the upper surface of the middle rail 38. Upon entering the slot, the material handling tote is guided past the cam-detent 32 by the forward cam surface portion 62 and will be prevented from being withdrawn from the slot by the interaction of the detent portion 64 of the cam detent 32 abutting the upper portion 54 of the vertical flange 52 of the tote guide which will prevent the inadvertent removal of a tote 46 from a pair of tote guides 10. For intentional removal of the material handling tote from a pair of tote guides 10, the front end of the tote must be raised and the tote tilted slightly to allow the upper portion 54 of the vertical flange 56 to pass beneath the detent portion 64 of the cam detent 32 (FIG. 6).

As will be apparent from the foregoing the tote guide of this invention provides a versatile lateral support for the storing of material handling totes beneath a work surface or the like which can be either side mounted to the vertical work surface support or to the underside of the work surface itself through top mounting. The tote guide of this invention prohibits the inadvertent removal of the totes from the tote guides while permitting easy intentional removal. It should also be apparent that a pair of tote guides can be spaced a predetermined distance apart to accommodate material handling totes either longitudinally or laterally as preferred.

What is claimed is:

1. A tote guide forming one side of a tote supporting means, said tote guide comprising:

a top rail, a middle rail, and a bottom rail, a first side member interconnecting said top rail and one side of said middle rail and a second side member interconnecting the other side of said middle rail and said bottom rail, each of said top rail and said first side member including a plurality of mounting apertures therethrough; and each of said middle and bottom rails including access apertures therethrough aligned with said mounting apertures in said top rail.

2. The tote guide according to claim 1 wherein said top rail and said bottom rail are substantially planar and said middle rail includes a depression therein.

3. The material handling tote according to claim 2 wherein said top rail includes a detent on the under side thereof, said detent constructed and arranged to prohibit removal of a material handling tote from between said top and middle rails without the tilting of said tote.

4. A tote guide forming one side of a material handling tote support, said tote guide comprising:

an elongated single piece member including a top rail, a first side wall, a middle rail, a second side wall, a bottom rail, and front and back end walls, said top rail and said middle rail being interconnected by said first side wall, and said middle rail and said bottom rail being interconnected by said second side wall, said top rail, first side wall and middle rail defining a first substantially U-shaped channel, said middle rail, said second side wall and said bottom rail defining a second elongated substantially U-shaped channel, said front wall closing off one end of said second substantially U-shaped channel and said back wall closing off the opposite ends of both of said first and second substantially U-shaped channels.

5. The tote guide according to claim 4 wherein each of said top rail and said first side wall include a plurality of mounting apertures therethrough.

6. The tote guide according to claim 5 wherein said middle rail and said bottom rail include access apertures therethrough aligned with said mounting apertures in said top rail.

7. The material handling tote according to claim 5 wherein said top rail and said bottom rail are substantially planar and said middle rail includes a depression therein.

8. The tote guide according to claim 7 wherein said top rail includes a detent of the underside thereof, said detent constructed and arranged to overlie said depression in said middle rail to thereby prohibit inadvertent removal of a material handling tote from between said top rail and said middle rail.

* * * * *